US005573118A

United States Patent [19]

Cramer et al.

[11] Patent Number: 5,573,118

[45] Date of Patent: Nov. 12, 1996

[54] NESTABLE OPEN HEAD DRUM

[75] Inventors: Harley L. Cramer, Swanton; Robert A. Huebner, Toledo, both of Ohio; Stephen E. Kipp, Mapelton, Ga.; Gary J. Toska, Rossford, Ohio

[73] Assignee: Walbro Corporation, Cass City, Mich.

[21] Appl. No.: 611,130

[22] Filed: Mar. 5, 1996

[51] Int. Cl.[6] ..... B65D 21/00

[52] U.S. Cl. ..... 206/505; 220/355; 220/675

[58] Field of Search ..... 220/355, 672, 220/675, 657, 659; 206/505

[56] References Cited

U.S. PATENT DOCUMENTS

| | | | |
|---|---|---|---|
| 3,009,603 | 11/1961 | Stockdale | 220/675 X |
| 3,349,941 | 10/1967 | Wanderer | 220/355 X |
| 4,004,710 | 1/1977 | Crisci | 220/355 X |
| 4,165,020 | 8/1979 | Hoselton | 206/505 X |
| 4,420,081 | 12/1983 | Dart | 220/675 X |
| 4,648,522 | 3/1987 | Wise | 206/505 X |
| 5,193,715 | 3/1993 | Schutz | 220/675 |
| 5,201,437 | 4/1993 | Burgdorf | 220/601 |

*Primary Examiner*—Steven M. Pollard

*Attorney, Agent, or Firm*—Barnes, Kisselle, Raisch, Choate, Whittemore & Hulbert

[57] ABSTRACT

A nestable open head container has a generally circular tapered sidewall and an enlarged diameter nesting ring which prevents the lids of adjacent containers from contacting each other during shipping and provides a nesting seat adjacent the top of the sidewall. When inserting a second container into a first container to nest them, the nesting seat of the second container contacts the rim of the first container to limit the depth of insertion of the second container. This maintains a gap between the containers when nested and substantially reduces the frictional engagement between them. A banding channel is formed in the container to receive a substantially inextensible band that releasably secures at least two containers adjacent to each other for increased stability of a package of containers during shipping.

13 Claims, 3 Drawing Sheets

NESTABLE OPEN HEAD DRUM

FIELD OF THE INVENTION

This invention relates to cylindrical shipping containers and more particularly to cylindrical shipping containers capable of being nested when empty.

BACKGROUND OF THE INVENTION

Large cylindrical containers have been commonly used to transport a wide variety of materials including liquids. One such container is shown in U.S. Pat. No. Des. 359, 150. It is well known to taper the side walls of such containers to allow the containers to be stacked or nested together when empty. However, current tapered sidewall drums provide a frictional fit between a substantial portion of the side walls of nested containers. This frictional engagement of nested containers makes it extremely difficult to separate the containers when reuse is desired. Further, this difficulty in separating the containers can result in damaging or destroying the containers upon separation.

Also, certain drum designs have the largest diameter of the container adjacent the open end of the container, such as shown in U.S. Pat. No. 5,201,437. When containers of this general design are stacked adjacent to each other the lids of neighboring containers can contact each other and potentially become damaged or loosened due to the jostling of the containers during shipping. This can reduce the integrity of the seal between the lid and the container with subsequent leakage as the result.

SUMMARY OF THE INVENTION

A nestable cylindrical shipping container is provided with a nesting ring and a nesting seat to greatly reduce the frictional engagement of nested containers. The nesting ring is an outwardly bowed section of the container adjacent the top of the container and the sidewall. The nesting ring has an outer diameter which is larger than the maximum diameter of the tapered sidewall. The nesting seat is adjacent the sidewall and contacts the top of a receiving container to limit the depth of insertion of the container when nested. Limiting the insertion of nested containers maintains a clearance between the sidewalls of the nested containers and thus reduces the frictional engagement of the containers. Thus, because of the gaps or clearances maintained between the nested containers the containers can be easily and manually separated without damaging the containers.

Further, to ensure that the containers do not collapse when filled and stacked on top of each other, the container is provided with two transitional sections, one at the top of the nesting ring and one at the bottom of the nesting ring. Each transitional section is inclined at an angle designed to maintain sufficient strength of the container while allowing for the outwardly bowed nesting ring to have a diameter greater than the diameter of the rim of the container. Because the nesting ring has a diameter that is larger than the diameter of the rim of the container, when the containers of this invention are stacked side by side, such as during shipping, they will contact each other adjacent there nesting rings and not adjacent their lids. This prevents the lids of the containers from being damaged or jarred loose during shipping. Further, to limit container movement and increase the stability of the containers during shipping, a banding channel is formed in the nesting ring to facilitate securing adjacent containers to each other.

Objects, features and advantages of this invention include providing a nestable open-head container suitable for shipping various materials including liquids that limits the frictional engagement of nested containers, prevents the lids of adjacent containers from contacting each other, provides a banding channel to allow several containers to be grouped together thereby increasing stability during shipping, has transitional sections to ensure the strength and integrity of the container under axial loading such as when the containers are filled and stacked on top of each other, enables easy manual separation of nested containers, is capable of being sufficiently sealed to prevent leakage of liquid or other materials during shipping, is strong, lightweight, durable, reusable and is of relatively simple design and economical manufacture.

BRIEF DESCRIPTION OF THE DRAWINGS

These and other objects, features and advantages of this invention will be apparent from the following detailed description of the preferred embodiment and best mode, appended claims, and accompanying drawings in which:

DETAILED DESCRIPTION OF THE PREFERRED EMBODIMENT

Figure 1:
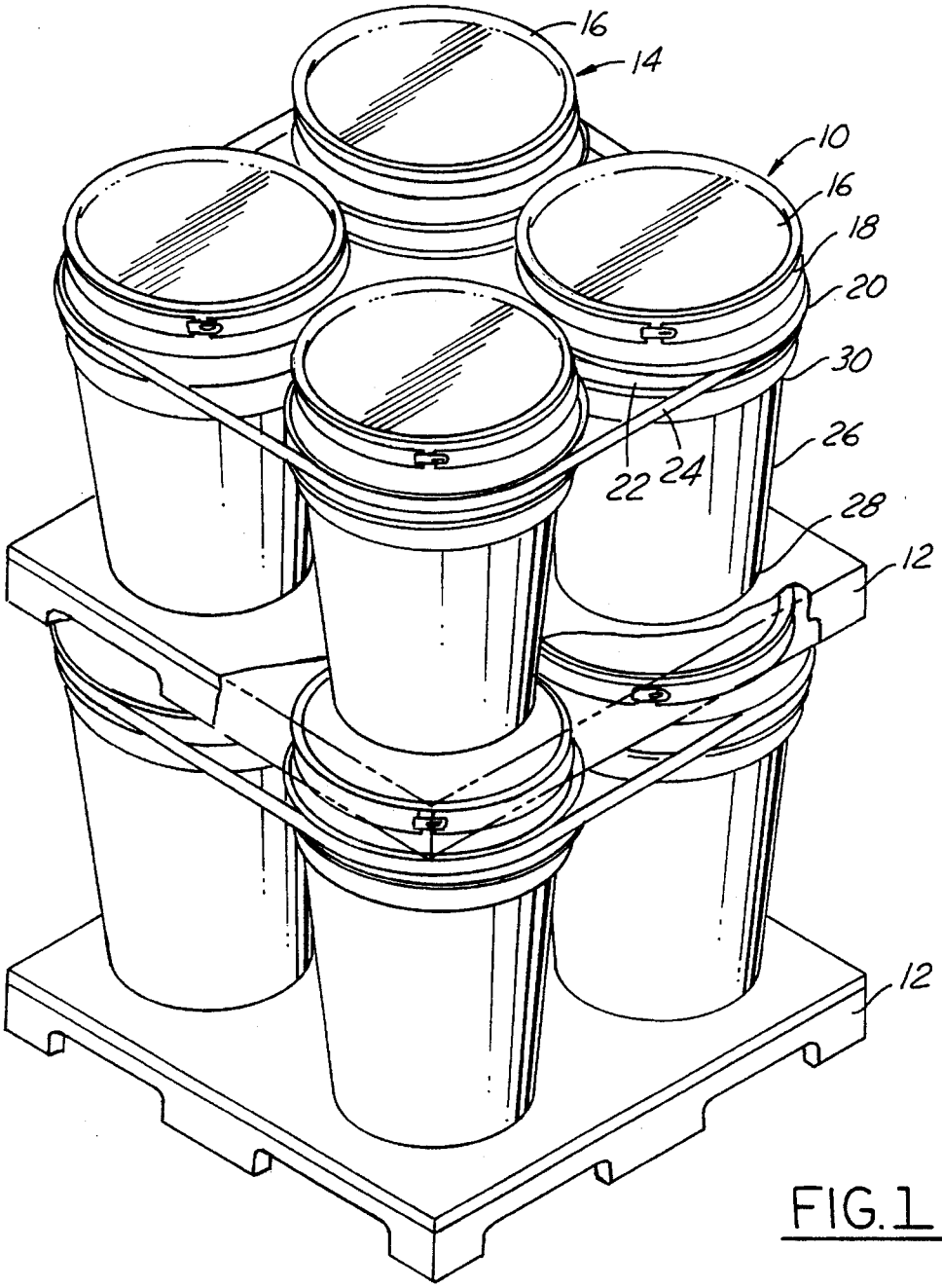
FIG. 1 is a perspective view showing several containers as typically stacked and arranged on pallets for storage or shipping.

FIG. 1 shows a plurality of large cylindrical containers 10 bundled and stacked on pallets 12 for shipping or storage. The containers 10 have an open top 14 closed by a lid 16 and a tension ring 18. Below the rim of the container 10 which is covered by the lid 16, a larger diameter section or nesting ring 20 is provided to prevent the lids 16 of adjacent containers 10 from contacting each other and potentially loosening or damaging each other when the containers 10 are bumped or jostled such as during shipping. To increase stability of the containers 10 during shipping, the nesting ring 20 is provided with a banding channel 22 constructed to receive a substantially inextensible tension band 24 therein to allow several containers 10 to be releasably secured adjacent each other such as shown in FIG. 1. In a preferred embodiment, the banding channel 22 of the container 10 is formed substantially adjacent the mid-point of the nesting ring 20. The bottom portion or sidewall 26 of the containers 10 are generally circular and are tapered to a base 28 such that when the containers 10 are empty they can be nested to reduce the space needed to store the containers 10.

Figure 2:
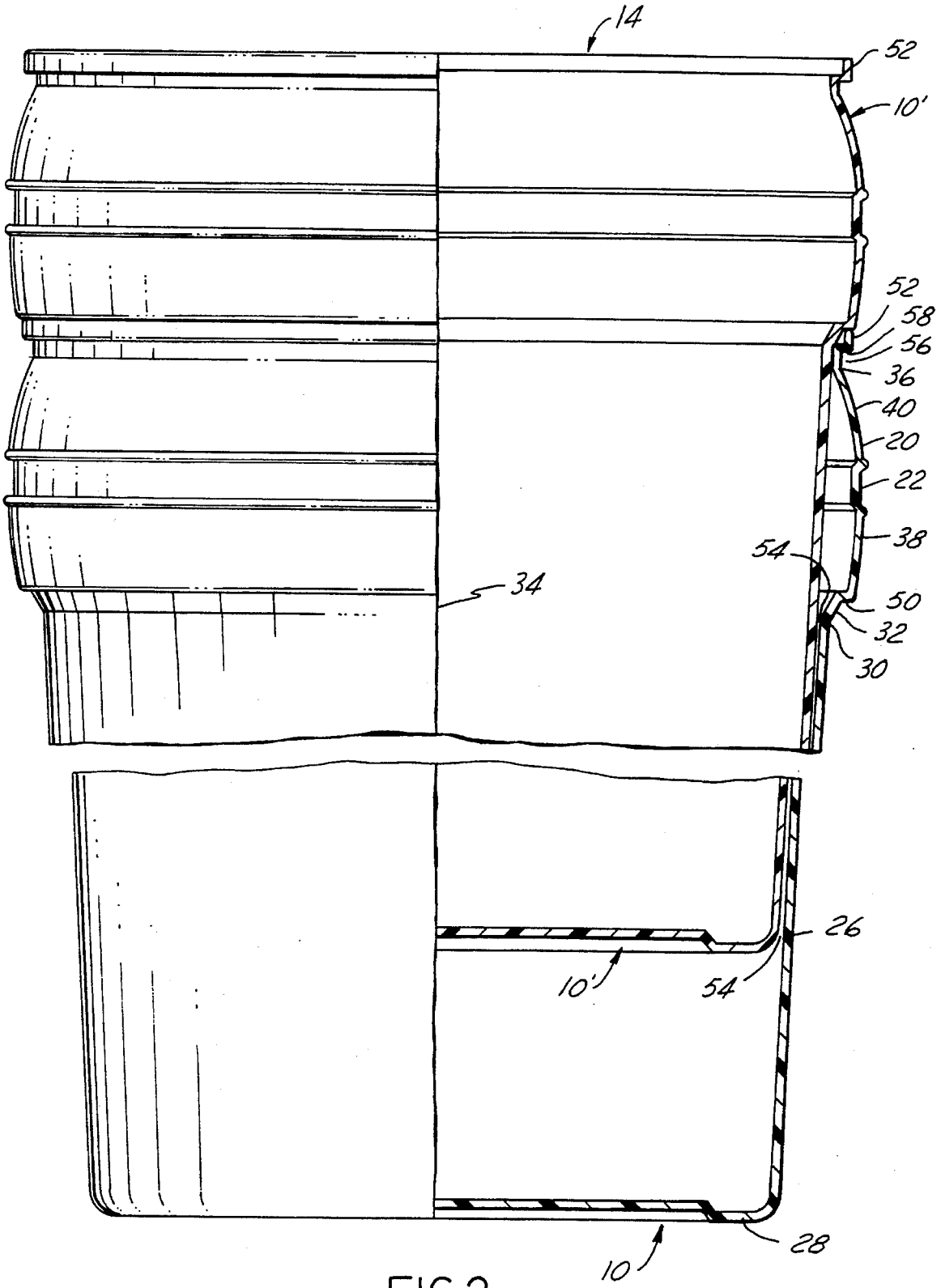
FIG. 2 is a partial sectional view illustrating two empty containers when nested.

FIG. 2 shows two empty containers 10 when nested. The containers 10 have a base 28 and a generally circular sidewall 26 attached adjacent the base 28. To allow the containers 10 to be nested when empty, the sidewall 26 is tapered providing a diameter at the top of the sidewall 30 that is larger than the diameter adjacent the base 28.

Figure 5:
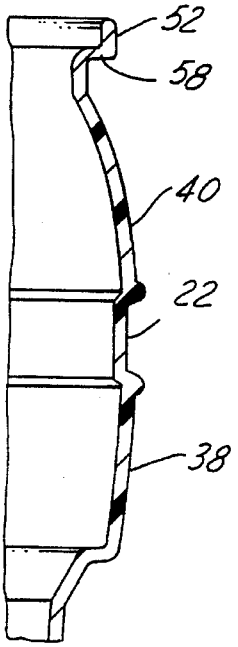
FIG. 5 is an enlarged fragmentary sectional view of the nesting ring and sidewall of the container.

As shown in FIGS. 2 and 5, a first transitional section 32 extends generally outwardly from the top of the sidewall 30 to the bottom of the nesting ring 20. To ensure the strength of this portion of the container when the container 10 is under axial loading, the first transitional section 32 is inclined at an acute included angle of preferably not more than about 45° relative to the axis 34 of the sidewall 26. Further, to limit the vertical height of the first transitional section 32, it is inclined at an angle not less than about 10°, and desirably, the first transitional section 32 is inclined at an acute included angle of about 25° to 40° and preferably about 30° relative to the axis 34 of the sidewall 26.

The nesting ring 20 preferably is a generally arcuate and outwardly bowed section which extends generally axially from the first transitional section 32 at its bottom 38, to a second transitional section 36 at the top 40 of the nesting ring 20. The ring 20 bows generally upwardly and outwardly from the first transitional section 32, until approximately the mid-point of the nesting ring 20. From that point, the nesting ring 20 bows back inwardly and upwardly to the second transitional section 36. Preferably to prevent the nesting ring 20 from collapsing under axial loading such as when filled containers 10 are stacked on top of each other, in cross-section the nesting ring spans an arc of not more than about 60° and preferably not more than about 45° with its center on the axis 34 of the sidewall 26.

To prevent the lids 16 of adjacent containers 10 from contacting each other and thereby potentially damaging each other during shipping, the nesting ring 20 has a maximum outside diameter which is larger than the maximum outside diameter of the lid 16. Thus, when adjacent containers 10 are banded together for shipping, as shown in FIG. 1, they contact each other adjacent their nesting rings 20 and not their lids 16.

As shown in FIG. 2, the nesting ring 20 also provides an annular nesting seat 50 adjacent the bottom 38 of the ring 20 and the first transitional section 32. The nesting seat 50 extends generally radially relative to the axis 34 of the sidewall 26 and has an outside diameter which is at least as large and preferably larger than the outside diameter of the rim 52. The seat 50 is constructed to contact the rim 52 when two containers 10 are nested to limit the insertion of the sidewall of the inserted container 10' into the receiving container 10. This provides a clearance or gap 54 between the sidewalls of the nested containers 10, 10' which greatly reduces the frictional engagement of the containers 10, 10' when nested. Preferably, the nesting seat 50 is located generally adjacent the top of the containers 10 to allow substantially complete insertion of nested containers 10 and thereby reduce the height of a stack of nested containers 10.

The second transitional section 36 extends generally inwardly and upwardly from the top 40 of the nesting ring 20 to provide a recess 56 adjacent the top 14 of the container 10. Preferably, to prevent the container 10 from collapsing adjacent the second transitional section 36 due to axial loading, the second transitional section 36 is inclined inwardly at an acute included angle of not more than about 45° relative to the axis 34 of the sidewall 26. Also preferably, to limit the axial height of the second transitional section 36 it is inclined at an acute included angle of not less than about 10° relative to the axis 34 of the sidewall 26. Desirably, the second transistional section is inclined at an acute included angle of about 25° to 40° and preferably, about 30° to the axis 34 of the sidewall.

To provide a close-fit between nested containers 10 without a significant frictional engagement between them, the minimum inside diameter of the recess 56 is slightly larger than the maximum outside diameter of the top 30 of the sidewall 26 which is adjacent to the recess 56 of a receiving container 10 when two containers 10, 10' are nested. This close-fit enhances the axial alignment of the containers 10 when nested which increases the stability of a stack of the nested containers 10.

A ledge 58 extends generally radially above the top of the recess 56 to provide a surface engaged by the tension ring 18 used to secure the lid 16 onto the top 14 of the container 10. An annular rim 52 extends generally axially from the outer most portion of the ledge 58 and provides an edge surface which contacts the nesting seat 50 of an inserted container 10' when nested. The rim 52 also provides a surface over which the lid 16 can be secured to the container 10.

Figure 3:
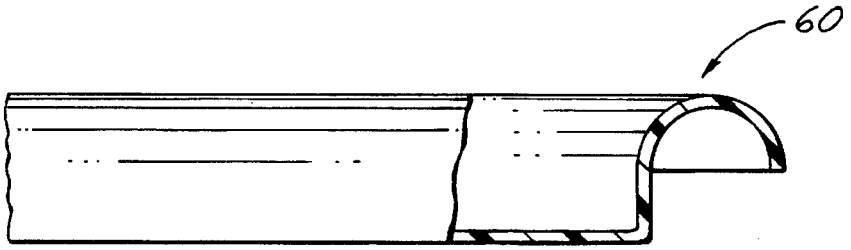
FIG. 3 is a fragmentary sectional view of a typical cover used to close the container.
Figure 4:
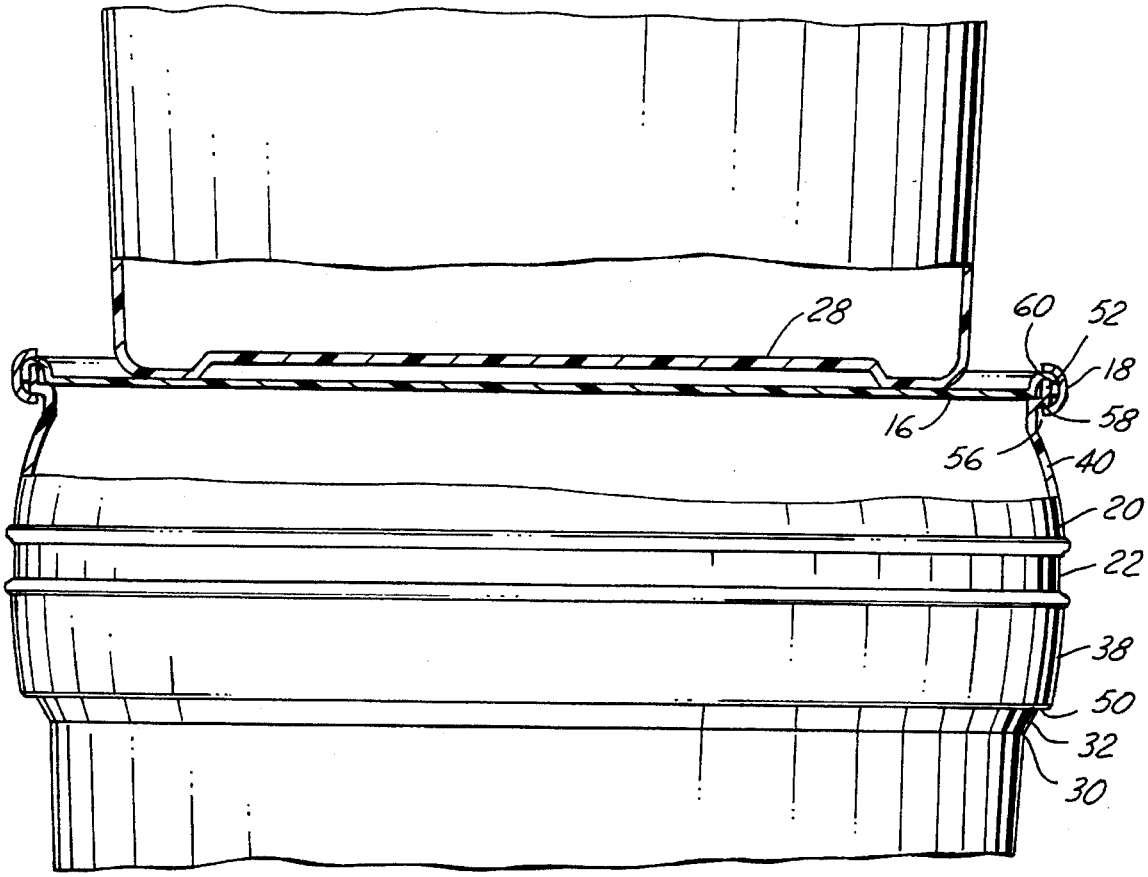
FIG. 4 is a partial sectional view illustrating two containers when stacked and also illustrating the engagement of the lid and the rim of the container.

As shown in FIG. 3, the lid 16 has an annular and generally U-shaped channel 60 formed about its periphery which is constructed to receive the rim 52 of the container 10. With the lid 16 in place, as shown in FIG. 4, the tension ring 18 is mounted adjacent the channel 60 of the lid 16 and the ledge 58 of the container 10. The diameter of the tension ring 18 when secured is slightly less than the outer diameter of the lid 16 to provide a close fit between the lid 16 and the tension ring 18, thereby providing a substantially liquid-tight seal between the lid 16 and the container 10.

All of the sections of the container 10 are preferably homogeneously integral and formed with a relatively thin wall of substantially uniform thickness. Preferably, the container 10 is formed from a non-toxic plastic suitable for contacting food such as a high-density polyethylene or polypropylene.

In use, the containers 10 are filled with a variety of materials including liquids and/or solids. The lid 16 is placed on the rim 52 of the container 10 with the rim 52 received in the channel 60 of the lid 16. The tension ring 18 is firmly secured to the lid 16 and ledge 58 of the container 10 to provide a substantially liquid-tight seal if needed. A plurality of filled containers 10 are then arranged on a shipping pallet 12 and a band 24 is releasably secured around the group of containers 10 on the pallet 12 to limit the individual movement of the containers 10. A second pallet 12 is placed on top of the first group of containers 10 and a second group of containers 10 are placed on the second pallet 12 and banded 24 together. Typically, the containers of this invention are stacked 5 groups high in the described manner.

When the containers are empty they are nested together to reduce the space needed to store or ship the empty containers. To nest the containers, the base 28 of a second container 10' is inserted into the open end 14 of a first container 10 until the nesting seat 50 of the second container 10' is in contact with the rim 52 of the first container 10. The process is repeated with a third container inserted into the second and so on. Because of the clearance 54 maintained between nested containers of this invention, the containers can be easily and manually separated when reuse of the containers is desired.

We claim:

1. A nestable container comprising a base, a generally cylindrical, tapered sidewall attached to said base, a first transitional section adjacent the top of said tapered sidewall and generally inclined outwardly at an acute included angle relative to the axis of the tapered sidewall, a nesting seat adjacent said first transitional section and extending outwardly thereof substantially radially, a generally arcuate nesting ring adjacent said seat, a second transitional section adjacent the upper edge of said nesting ring and inclined inwardly at an acute included angle relative to the axis of the tapered sidewall, a recess formed in said container adjacent said second transitional section, a ledge adjacent to and extending generally radially outwardly from the root of said recess and constructed to be engaged by a tension ring used to secure a lid on the container and a rim extending generally axially from said ledge and defining the upper most portion of said container, said rim being constructed to contact the nesting seat of a second container to limit the insertion of the second container into the container to maintain a clearance between the tapered sidewalls of the containers thereby substantially limiting the frictional engagement of the containers when nested.

2. The container of claim 1 wherein said rim, ledge, recess, first and second transitional sections, nesting ring, sidewall and base are homogeneously integral.

3. The container of claim 2 wherein said banding channel is formed in said nesting ring.

4. The container of claim 1 wherein the acute included angle between said first transitional section and the axis of the tapered sidewall is between about 10° and 45°.

5. The container of claim 4 wherein the acute included angle between said first transitional section and the axis of the tapered sidewall is between about 25° to 40°.

6. The container of claim 1 wherein the acute included angle between said second transitional section and the axis of the tapered sidewall is between about 10° and 45°.

7. The container of claim 6 wherein the acute included angle between said second transitional section and the axis of the tapered sidewall is between about 25° to 40°.

8. The container of claim 1 wherein said nesting ring has an outside diameter larger than the outside diameter of said rim to substantially prevent the rims of adjacent containers from contacting each other during loading and shipping of the containers.

9. The container of claim 1 wherein the minimum inside diameter of the second transitional section is larger than the maximum outside diameter of the upper most portion of the sidewall immediately adjacent the first transitional section to prevent the sidewall of a second container from firmly frictionally engaging said second transitional section before the seat of the second container is in contact with said rim of said container.

10. The container of claim 1 wherein said container also has a banding channel constructed to receive a substantially inextensible band to facilitate securing together at least two containers for increased stability during shipping.

11. The container of claim 1 wherein said nesting ring is located substantially adjacent the top of the container to allow the containers to be almost entirely inserted into each other when nested.

12. The container of claim 1 wherein said nesting ring spans an arc not greater than 60° with the center of the arc on the axis of the tapered sidewall to maintain strength and integrity of the container at said ring under axial loading of said container.

13. The container of claim 12 wherein the arc of the nesting ring is not greater than about 45°.

* * * * *